US005303566A

United States Patent [19]

Wolney et al.

[11] Patent Number: 5,303,566

[45] Date of Patent: Apr. 19, 1994

[54] FRONT-LOADING WASHING MACHINE DRAIN SYSTEM

[76] Inventors: Joseph A. Wolney, 542 Summit St. NE., Columbia Heights, Minn. 55421; Thomas A. Wolney, Sr., 2934 Irving Ave. N., Minneapolis, Minn. 55411

[21] Appl. No.: 911,739

[22] Filed: Jul. 10, 1992

[51] Int. Cl.[5] ..... D06F 39/08

[52] U.S. Cl. ..... 68/208; 68/184; 137/577; 134/155

[58] Field of Search ..... 134/155, 186, 109; 68/208, 12.19, 139, 181 R, 184; 137/562, 577; 210/537

[56] References Cited

U.S. PATENT DOCUMENTS

| | | | |
|---|---|---|---|
| 2,538,200 | 1/1951 | Johnston | 18/208 |
| 2,900,080 | 8/1959 | Raczynski | 68/208 |
| 2,953,159 | 9/1960 | Geschka | 68/208 X |
| 3,070,984 | 1/1967 | Thomas | 68/208 |
| 3,590,606 | 7/1971 | Takeyama | 68/208 |

FOREIGN PATENT DOCUMENTS

| | | | |
|---|---|---|---|
| 1120595 | 4/1956 | France | 68/208 |
| 60-26000 | 6/1985 | Japan | 68/208 |
| 890870 | 3/1962 | United Kingdom | 68/208 |

*Primary Examiner*—Frankie L. Stinson
*Attorney, Agent, or Firm*—Lawrence M. Nawrocki

[57] ABSTRACT

A drain system for adapting the drain/extraction plumbing of a front-loading washing machine which includes an agitator drum mounted for rotation about a generally horizontal axis, means for driving the drum in rotation about the axis during the various cycles of the machine, and a drain pipe extending downward from the agitator drum and disposed to convey a water/suds mixture vacated from the agitator drum away from the drum. The system includes a conduit into which the water/suds mixture is conveyed from the drain pipe. The conduit is oriented generally horizontally with a first end of the conduit intersecting, and being in fluid communication with, the distal end of the drain pipe. The water/suds mixture, as it is channeled through the conduit, separates into a water component and a suds component floating on the water component. The system includes a water scavenger line and a suds duct, both of which diverge and extend from the second end of the conduit. A baffle is interposed in the system to occlude an upper portion of the water scavenger line so as to permit the water component of the mixture to enter the water scavenger line yet divert the suds component of the mixture into the suds duct.

7 Claims, 3 Drawing Sheets

FRONT-LOADING WASHING MACHINE DRAIN SYSTEM

TECHNICAL FIELD

The present invention deals broadly with the field of machines for washing clothing and other such items. More narrowly, however, the invention deals with front-loading washing machines. The specific focus of the invention is a drain system for channeling water and suds components of a by-product residue of the washing process.

BACKGROUND OF THE INVENTION

Washing machines have applications in both commercial and residential situations. Large machines are employed in commercial laundry facilities for washing, for example, institutional items such as hospital sheets, pillow cases, etc.

Certainly, washing machines have distinct advantages in a residential setting. Depending upon the size of a family, a washing machine in the dwelling might be used as infrequently as once each week, and as frequently as multiple times each day.

In both residential and commercial settings, a number of types of machines are available for purchase. These machines fall primarily into two categories. These categories are front-loading machines and top-loading machines.

Front-loading machines include an agitator drum which is disposed for rotation about a generally horizontal axis. As the drum rotates, the items within the drum will be tossed upward and agitated to facilitate the washing process.

In top-loading machines, an agitator disposed for rotation about a generally vertical axis is employed. Agitation is effected by the beating of clothes by agitator vanes.

It is generally conceded that front-loading machines have definite advantages over top loaders. This is so for a number of reasons.

First, front loaders tend to use less soap. This is because of the manner in which the water and soap are mixed together. Because of the tumbling action induced by a front loader, an aeration effect is created. This aeration effect generates more suds with a given quantity of soap then does a top-loading machine with the same quantity of soap. As a result, most soap and detergent manufacturers recommend that less than half of the washing agent amount suggested for top loaders be used with a front-loading machine.

Second, with a front loader, the water tumbling effect results in a cleaner, more effective process. As a result, the process is safer to the fabrics being washed. The harmful effects of agitator vanes or paddles are eliminated. Further, the typical consequent winding of clothing items tightly around the agitator member is eliminated with a front-loading machine. This result is particularly advantageous in the case of sensitive fabric blends such a pure cottons, pure wools, and linen fabrics. The chance of fraying is, as a result, minimized.

Front-loading machines also tend to have a longer useful life. In view of the nature of their operation, they are, typically, more solidly constructed and, frequently, even reinforced. Because of this more durable construction, front loaders can even be used in laundromats where they are subjected to particularly adverse handling.

Because of gravitational forces exerted upon the front loader during the drain/extraction cycle (that is, spin cycle), a front-loading machine is, typically, securely bolted to a foundational base surface. If such were not the case, the machine could lurch and tip over during the cycle. The bolting of the machine to the substrate, further, enables the front loader to out-perform a typical top loading machine.

Front-loading washers also tend to be less complex. The agitator drum is driven by a duty-rated motor having reverse and high-speed motor windings. The motor, in turn, attaches directly to the pulley for driving the drum by a standard belt-to-drum assembly. Electrical relay operation of the drum rotation is employed.

Top-loading machines, however, depend upon complex mechanical transmission and clutch units. Typically, such units are located inaccessibly underneath the agitator. Top-loaders also depend on a motor which shifts to different operating modes by a complicated configuration of drives and pulleys in order to drive the agitator mechanism. In view of these drawbacks, the repair of a problem can cost as much as buying a new top-loading machine. When a serious mechanical problem occurs with a top-loader, the machine often has to be removed from its location and completely disassembled.

With all of the advantages of a top-loading machine, such machines are not completely devoid of problems. Because of the small volume of soap or detergent necessary in their operation, owners of front loaders frequently use too much cleaning agent. This can result in over-sudsing and possible damage to the machine. At a minimum, difficulty in draining can result. Drain pumps which are typically interposed in the drain pipe can become vapor-locked. When this occurs, the functioning of the machine is diminished.

It is to these problems and positive dictates of the prior art that the present invention is directed. It is a drainage system which achieves the positive characteristics of a front-loading washing machine while solving many of the problems of the prior art.

SUMMARY OF THE INVENTION

The present invention is a drain system including plumbing to adapt a front-loading washing machine in order to effect efficient draining and vacating of a water/suds mixture from an agitator drum of the machine. Front-loading washing machines include such an agitator drum which is disposed for rotation about a generally horizontally oriented axis. Further, such machines include means for driving the drum in the intended rotation of the axis during the various wash, rinse, and drain/extraction cycles. In the drain system invention, a first conduit is provided to vacate the agitator drum of the water/suds mixture. The conduit extends downward from the drum and is disposed in a location relative to the drum to convey a water/suds mixture away from the drum by means of gravity and centrifugal action. A second conduit having first and second ends is also included. The second conduit is oriented generally horizontally and is positioned such that a first end thereof intersects, and is in fluid communication with, a distal end of the first conduit. Consequently, the water/suds mixture by-product of washing and rinse cycles is channeled into and through the conduit in such a manner so that it is separated into a water component and a suds component which floats on the water component as the mixture passes through the second conduit. The invention also includes a water scavenger line and a suds duct, both of which extend from, and diverge with respect to, the second end of the second conduit. The water scavenger line is generally aligned with the lower portion of the second conduit, and the suds duct is generally aligned with the upper portion of the second conduit. Consequently, the water component will tend to flow into the water scavenger line and the suds component will tend to flow into the suds duct.

A baffle can be provided proximate the second end of the second conduit to facilitate separation of the water and suds components. The baffle is positioned to facilitate the water component of the mixture having passed through the second conduit to enter the water scavenger line. At the same time, however, the baffle functions to divert the suds component having passed through the second conduit into the suds duct.

The invention also envisions an embodiment to be used in adapting an existing front-loading washing machine so that it functions as would the drainage system previously discussed. A front-loading washing machine, typically, includes a drain pipe which functions to accomplish vacation of the water/suds by-product from the agitator drum as does the first conduit in the drain system described above. That is, it is positioned relative to the agitator drum so that the water/suds by-product is vacated from the drum through the drain pipe by gravity and centrifugal action.

In this adaptor embodiment of the invention, a conduit is provided to intersect the drain pipe at its end distal from the agitator drum. The conduit is oriented generally horizontally and functions to separate the suds component from the water component of the by-product mixture in a manner wherein the suds component floats to the top of the water component as the mixture is channeled through the duct. This embodiment also includes a water scavenger line and a suds duct diverging from one another at a second end of the generally horizontally oriented mixture channeling duct.

This embodiment can also include a baffle as described above. That is, it can include a baffle which occludes an upper portion of the water scavenger line so as to permit the water component to pass into the water scavenger line yet divert the suds component into the suds duct.

In certain embodiments, a mechanical pump can be interposed in the water scavenger line. The provision of such a pump enables more efficient drawing of the by-product mixture through the duct extending from the drain pipe to the location at which the water scavenger line and suds duct diverge. More efficient separation of the water and suds components and drainage of the water component are, thereby, achieved.

It will be understood that such a pump can be employed in the overall drainage system embodiment also. That is, a pump can be included in the water scavenger line of an embodiment including a first conduit extending downwardly from the agitator drum. More efficient drainage, separation of by-products, and passage of the separated components for further disposition are, thereby, accomplished.

The present invention is thus an improved drainage system and drainage system adaptor for use in combination with a typical front loading washing machine. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
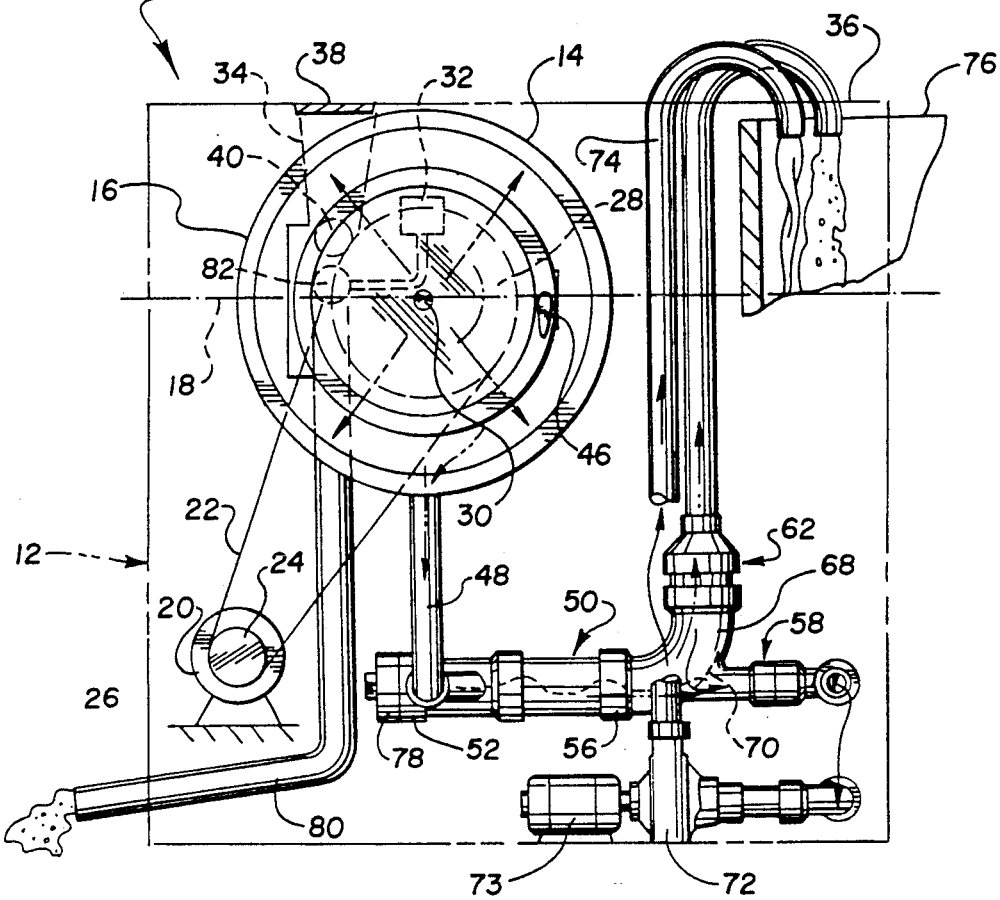
FIG. 1 is a front elevational diagram of a typical front-loading automatic washing machine as incorporating the present invention.
Figure 2:
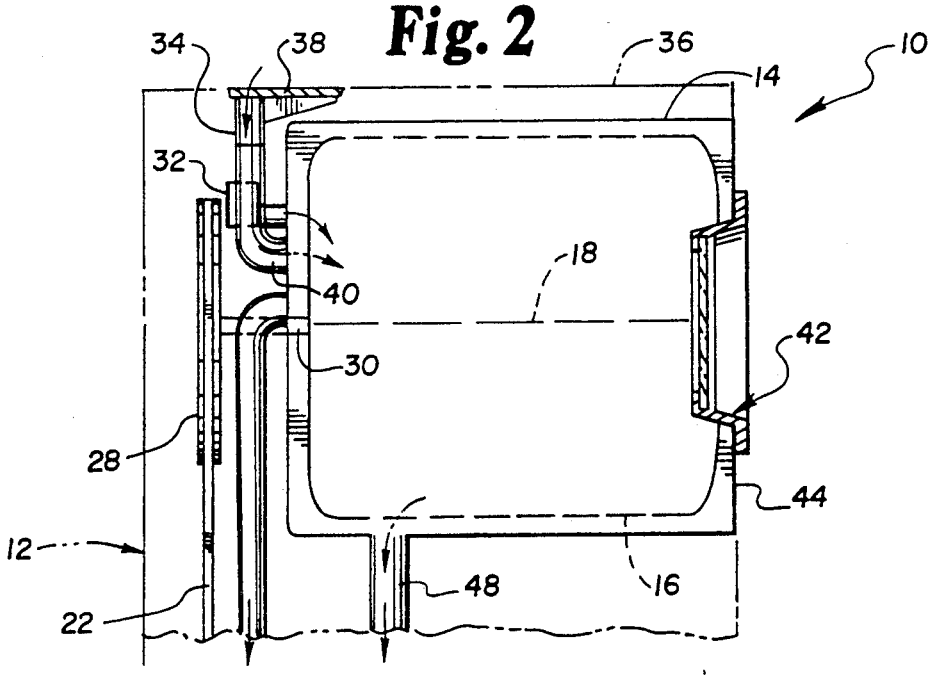
FIG. 2 is a fragmentary side elevational diagram of the washing machine illustrated in FIG. 1.

Referring now to the drawings, and particularly FIGS. 1 and 2, wherein like reference numerals denote like elements throughout the several views, a typical front-loading washing machine 10 as known in the prior art is illustrated. In addition to the machine 10 of the prior art, however, those two figures also illustrate structure in accordance with the present invention reconfiguring and/or adapting a known machine.

FIGS. 1 and 2 show a machine having an enclosure housing 12. The housing 12, in turn, mounts therewithin a tub structure 14. The tub 14 disposes within its generally cylindrical wall an agitator drum 16. The drum 16 is disposed for rotation about a generally horizontal axis 18.

Rotation of the agitator drum 16 is accomplished by means of a drive motor 20. Rotational motion generated by the drive motor 20 is transmitted to the agitator drum 16 by means of a drive belt 22 which extends around a drive sprocket 24 carried by the motor shaft 26 and a driven sprocket 28 carried by a shaft 30 aligned along the axis 18 of rotation of the agitator drum 16. Typically, the drive belt 22 has a "V" cross-section. It is, thereby, more readily maintained in position with respect to the sprockets 24, 28 and precluded from slipping off.

A typical front-loading washing machine includes a water inlet 32 through which water from a source (not shown) is fed into the agitator drum 16 for wash and rinse cycles. A machine of the construction illustrated in the drawings also includes a soap compartment 34 into which soap or detergent is poured. Typically, such a compartment 34 is accessible through a top panel 36 of the enclosure housing 12 and is normally closed by a door 38. When the operator of a machine wishes to insert soap or detergent into the soap compartment 34, the door 38 can be pivoted into an open position and closed after the compartment 34 has been filled with the desired amount of soap or detergent.

A soap inlet 40 interconnects the compartment 34 to the agitator drum 16 so that, during the wash cycle, soap or detergent in the compartment 34 can be fed into the drum 16 to effect cleaning of the clothes or other fabric materials in the drum 16. As seen in FIG. 2, the inlet 40 inputs the soap or detergent into the drum 16 at a height above the axis 18 of rotation above the drum 16. During wash and rinse cycles, the water level within the drum 16 is intended to be approximately at the height of the axis 18. As a result, soap or detergent dispensed into the drum 16 is done so at a height above the water level. This allows for more efficient dispensing of the soap or detergent powder.

It will be understood that in the typical front-loading washing machine a sensor can be incorporated for ascertaining when the water level which is desired within the drum 16 has been achieved. Since such a sensor does not comprise part of the present invention, however, it is not shown in the drawing figures. Discussion is given merely for a better understanding of overall machine operation.

An operator of the machine 10 will insert clothes to be laundered through a sealed door 42 in the front panel 44 of the enclosure housing 12. After the machine 10 is loaded with clothes to be washed, the door 42 is closed (thereby effecting a seal along the aperture surface defined in the front panel 44), and the door 42 is locked closed by a latch 46. The operator then initiates a series of cycles by means of a sequencer (not shown). Typically, such cycles include a wash cycle, one or more rinse cycles, and a drain/extraction cycle after the wash cycle and each rinse cycle. During the wash and rinse cycles, the agitator drum 16 is rotated about its axis 18 to agitate the clothes so as, during the wash cycle, to effect interspersion of the soap or detergent settled into the items to be laundered, and, during a rinse cycle, to extract a maximum of the soap or detergent in the garments. Typically, agitation during the wash and rinse cycles is relatively gentle and in a tumbling fashion.

Each drain/extraction cycle serves to vacate the agitator drum 16 of wash or rinse by-product (that is, a mixture of water and soap suds generated by the washing and rinsing processes). During these drain/extraction cycles, the agitator drum 16 is rotated at a high speed, and the water/suds mixture by-product is expelled centrifugally from the drum 16 into a first conduit or drain 48. Typically, the drain pipe or conduit 48 extends downwardly from the agitator drum 16, and the centrifugal vacation of the water/suds mixture is augmented by gravity. Because of the high speed of rotation of the drum 16 during the drain/extraction cycles, centrifugal vacation of the wash and rinse cycle by-products is accomplished to a high degree. The structure and operation described to this point is typical of front-loading washing machines known in the prior art. It has been described herein merely to serve as a background for further discussion to the improvement invention in accordance with this document.

Figure 3:
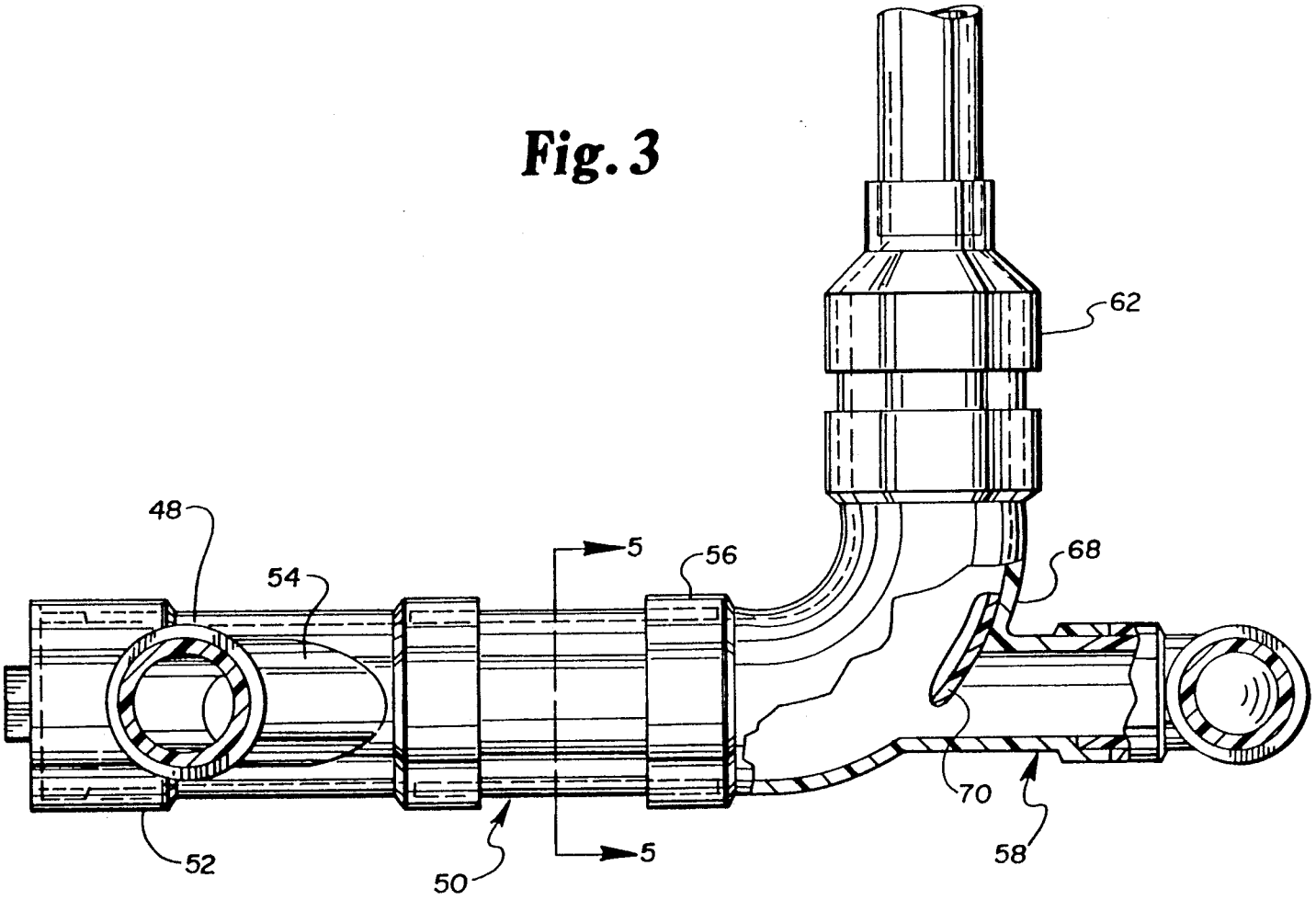
FIG. 3 is a fragmentary enlarged front elevational view of a separator portion of the system invention shown in FIGS. 1 and 2.
Figure 6:
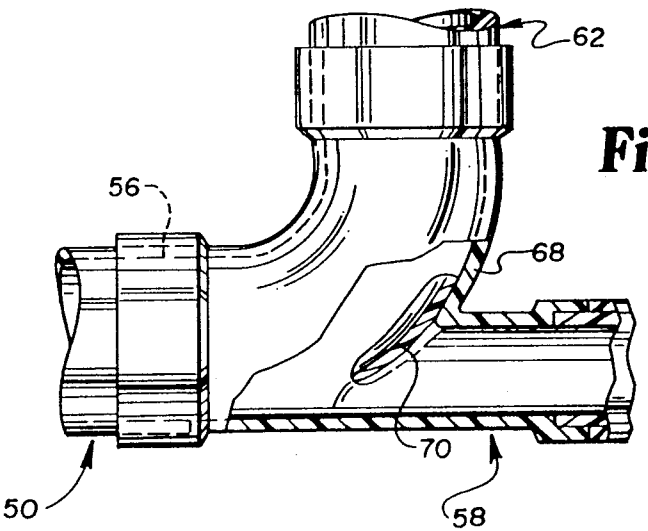
FIG. 6 is a fragmentary view similar to that of FIG. 3.
Figure 5:
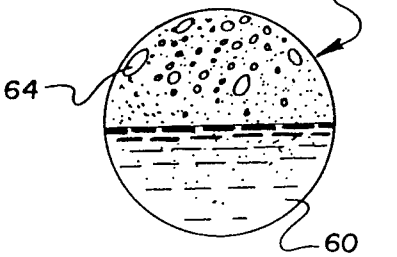
FIG. 5 is a simplified section taken generally along line 5—5 in FIG. 3.

FIGS. 1–4 illustrate a second conduit 50 intersecting, at its first end 52, a distal end 54 of the drain pipe 48. These figures illustrate this second conduit 50 as being disposed generally horizontally. The second conduit 50 is in fluid communication with the drain pipe 48 so that the water/suds by-product mixture of the wash and rinse cycles is channeled into the second conduit 50 and passes therethrough. FIGS. 3 and 6 best illustrate the structure of the invention proximate the second end 56 of the second conduit 50. Those figures illustrate a water scavenger line 58 which is intended to transfer a water component 60 of the by-product mixture for disposal or recycling, and a suds duct 62 which functions to transfer the suds component 64 for disposal. Those figures illustrate the water scavenger line 58 as having a smaller diameter than the second conduit 50 which intersects the drain pipe 48. The water scavenger line 58 is generally axially aligned, at least initially, with the lower portion of the second conduit 50. It is shown as, thereafter, bending 90° through an elbow fitting 66.

The suds duct 62, however, is shown as being diverted upwardly with respect to the water scavenger line 58. The figures illustrate a 90° elbow 68 being employed to accomplish this diversion.

As best seen in FIGS. 3 and 6, a baffle 70 is shown as being employed to occlude an upper portion of the water scavenger line 58. The baffle 70 is showing as having been made to conform substantially to the contours of the plumbing at the location at which it is positioned.

As previously discussed, the high rate of rotation of the agitator drum 16 during the drain/extractor cycles, centrifugally impels the water/suds mixture from the drum 16. A measure of momentum is imparted to the mixture as it passes through the drain pipe 48 in consequence. This momentum is augmented when, as shown in the drawing figures, the drain pipe 48 extends downwardly from the agitator drum 16.

This momentum continues, although to an attenuated extent, as the mixture passes through the length of the second conduit 50. The mixture continues to be impelled through the second conduit 50 from the first end 52 to the second end 56 thereof. As the mixture passes along this generally horizontal conduit 50, however, the suds component 64 will tend to rise and float on the surface of the water component 60. This is so since the suds component 64 is highly aerated.

It will be understood that some of amounts of soap or detergent will remain entrained in the water component 60. This is so in view of the solubility of the soap or detergent. Any such dissolved material, however, does not present any problems from a disposal standpoint since it is not aerated and will not give rise to vapor lock in any pump 72 that might be interposed in the water scavenger line 58.

As previously discussed, the upper portion of the water scavenger line 58 is occluded by the baffle 70. This fact, in combination with the fact that the water scavenger line 58 is aligned with a lower portion of the second conduit 50 results in only water or water having dissolved soap or detergent therein entering the water scavenger line 58.

FIG. 1 illustrates a pump 72 driven by a motor 73 interposed in the water scavenger line 58. This pump 72 serves a number of functions. First, it facilitates the pumping of the water component 60 to a location for discharge and disposal or recycling. FIG. 1 illustrates the water component 60 being elevated through a stand pipe 74 so that it can be disposed of, for example, in a laundry tub 76. Additionally, however, the pump 72 serves to generate vacuum to draw the mixture through the second conduit 50 at a higher rate of flow than it would have otherwise.

As previously discussed, as the mixture passes through the second conduit 50, the suds component 64 separates from the water component 60 and rises to the surface of the water component 60. As the now at least partially separated components 60, 64 approach the second end 56 of the second conduit 50, the suds component 64 will engage the baffle 70 and be diverted upwardly through the suds duct 62 for disposal. The suds can be disposed of in the laundry tub 76 also.

Figure 4:
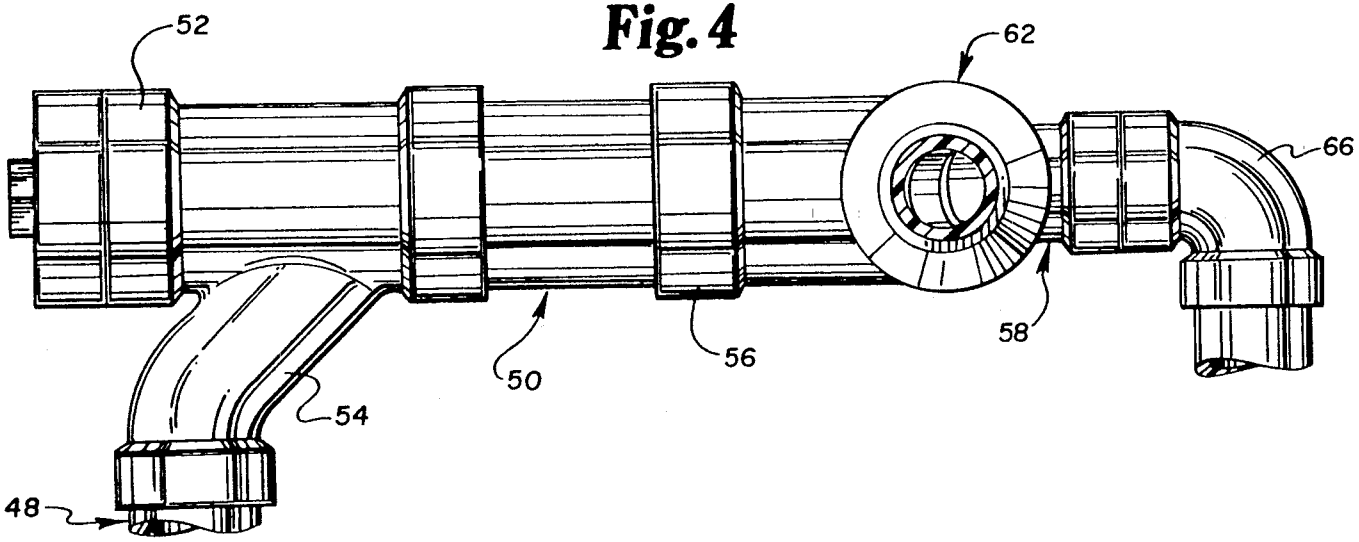
FIG. 4 is a top plan view of the structure illustrated in FIG. 3.

FIGS. 3 and 4, in particular, illustrate a clean-out structure. This structure comprises a cap 78 fitted onto the first end 52 of the second conduit 50. The cap 78 is removable in order to afford access to the interior of the second conduit 50. The cap 78 can be removed by an operator of the equipment, and any undesirable sludge or other residue accumulating within the second conduit 50 can be removed.

It will be understood that, in the typical front-loading washing machine, not all of the suds generated during a washing or rinsing cycle will be impelled into the drain pipe 48. Front loading washing machines, typically, include an overflow pipe 80 having an inlet 82 at the agitator drum 16. The inlet 82 is, typically, disposed at a height immediately above the intended water level in the drum 16. As a result, initial excess suds will enter the overflow pipe 80 and be fed by gravity, for example, to a drain (not shown). The presence of such an overflow pipe 80, thereby, reduces the amount of suds component 64 being passed into the second conduit 50 for separation therein. Consequently, the present invention will function more efficiently.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A drain adaptor for use in combination with a front-loading washing machine which has an agitator drum disposed for rotation about a generally horizontally-oriented axis, means for driving the drum in rotation about the generally horizontally-oriented axis during wash, rinse, and drain/extraction cycles, and a drain pipe extending downward from a bottom of the agitator drum and disposed to commonly convey a water/suds waste mixture, vacated form the agitator drum by gravity and centrifugal action, away from the agitator drum, comprising:

(a) a generally horizontally-oriented conduit having first and second ends, said first end of said conduit intersecting, and being in fluid communication with, a distal end of the drain pipe, wherein the water/suds waste mixture vacated from the agitator drum through the drain pipe is channeled and impelled into and through said conduit and separates into a water component and a suds component, floating on the water component, as the waste mixture is channeled and impelled through said conduit from said first end to said second end thereof;

(b) a water scavenger line extending from said second end of said conduit and aligned with a lower portion thereof; and (c) a suds duct extending from said second end of said conduit and aligned with an upper portion thereof.

2. A drain system for a front-loading washing machine including an agitator drum disposed for rotation about a generally horizontally oriented axis and means for driving the drum in rotation about the generally horizontally disposed axis during wash, rinse, and drain/extraction cycles, comprising:

(a) a first conduit extending downwardly from a bottom of the agitator drum and disposed to commonly convey a water/suds waste mixture, vacated from the agitator drum by gravity and centrifugal action, away from the agitator drum;

(b) a second generally horizontally oriented conduit having first and second ends, said first end of said second conduit intersecting, and being in fluid communication with, a distal end of said first conduit, wherein the water/suds waste mixture vacated from the agitator drum through said first conduit is channeled and impelled into, and through, said second conduit and separates into a water component and a suds component, floating on the water component, as the waste mixture is channeled and impelled through said second conduit from said first end to said second end thereof;

(c) a water scavenger line extending from said second end of said second conduit and aligned with a lower portion thereof; and (d) a suds duct extending from said second end of said second conduit and aligned with an upper portion thereof.

3. A drain system in accordance with claim 2 further comprising a baffle disposed proximate said second end of said second conduit to permit the water component of the waste mixture to enter into said water scavenger line, and to divert the suds component of the waste mixture into said suds duct.

4. A drain system in accordance with claim 3 wherein said suds duct angles upwardly relative to said water scavenger line.

5. A drain system in accordance with claim 4 wherein said baffle occludes an upper portion of said water scavenger line.

6. A drain system in accordance with claim 3 further comprising a pump interposed in said water scavenger line to draw the water component of the waste mixture through said second conduit and to a discharge.

7. A drain adaptor for use in combination with a front-loading washing machine which has an agitator drum disposed for rotation about a generally horizontally-oriented axis, means for driving the drum in rotation about the generally horizontally-oriented axis during wash, rinse, and drain/extraction cycles, and a drain pipe extending downward fro a bottom of the agitator drum and disposed to commonly convey a water/suds waste mixture, vacated from the agitator drum by gravity and centrifugal action, away from the agitator drum, comprising:

(a) a generally horizontally-oriented conduit having first and second ends, said first end of said conduit intersecting, and being in fluid communication with, a distal end of the drain pipe, wherein the water/suds waste mixture vacated from the agitator drum through the drain pipe is channeled and impelled into and through said conduit and separates into a water component and a suds component, floating on the water component, as the waste mixture is channeled and impelled through said conduit from said first end to said second end thereof;

(b) a water scavenger line extending from said second end of said conduit;

(c) a suds duct extending from said second end of said conduit;

(d) a baffle disposed proximate said second end of said conduit to permit the water component of the waste mixture to enter said water scavenger line ,and to divert the suds component of the waste mixture into said suds duct; and (e) a pump interposed in said water scavenger line at a location spaced down-flow from said baffle.

* * * * *